US010443322B2

(12) United States Patent
Bernard et al.

(10) Patent No.: US 10,443,322 B2
(45) Date of Patent: Oct. 15, 2019

(54) PROTECTION OF DOWNHOLE TOOLS AGAINST MECHANICAL INFLUENCES WITH A PLIANT MATERIAL

(71) Applicant: BAKER HUGHES INCORPORATED, Houston, TX (US)

(72) Inventors: Stephan Bernard, Celle (DE); Robert Buda, Celle (DE)

(73) Assignee: BAKER HUGHES, A GE COMPANY, Houston, TX (US)

( * ) Notice: Subject to any disclaimer, the term of this patent is extended or adjusted under 35 U.S.C. 154(b) by 273 days.

(21) Appl. No.: 14/964,223

(22) Filed: Dec. 9, 2015

(65) Prior Publication Data

US 2017/0167206 A1 Jun. 15, 2017

(51) Int. Cl.
*E21B 17/10* (2006.01)

(52) U.S. Cl.
CPC ..... *E21B 17/10* (2013.01)

(58) Field of Classification Search
CPC .... E21B 33/12; E21B 33/1243; E21B 33/126; E21B 33/127; E21B 43/108; E21B 17/10; E21B 17/1042; E21B 33/1277; E21B 17/1014; E21B 47/01; E21B 47/011
See application file for complete search history.

(56) References Cited

U.S. PATENT DOCUMENTS 3,667,817 A 6/1972 Kellner
4,512,419 A 4/1985 Rowley et al.
5,419,397 A * 5/1995 Reynolds ..... E21B 17/1042 166/173
5,437,342 A 8/1995 Powada
5,579,839 A * 12/1996 Culpepper ..... E21B 33/1208 166/118
5,883,018 A 3/1999 Bourgois et al.
5,901,789 A * 5/1999 Donnelly ..... E21B 43/04 166/207
6,877,553 B2 * 4/2005 Cameron ..... E21B 17/026 166/207
6,932,159 B2 * 8/2005 Hovem ..... E21B 43/08 166/227
7,048,048 B2 * 5/2006 Nguyen ..... E21B 43/088 166/207
7,412,761 B2 8/2008 Male et al.
7,681,653 B2 * 3/2010 Korte ..... E21B 23/06 166/285
7,695,542 B2 4/2010 Drivdahl et al.
8,123,888 B2 2/2012 Hammami et al.
8,154,420 B2 4/2012 Petrovic et al.
8,201,636 B2 * 6/2012 Gandikota ..... E21B 33/1208 166/206
2009/0200013 A1 8/2009 Craster et al.
2013/0206273 A1 8/2013 Guest et al.
(Continued)

FOREIGN PATENT DOCUMENTS

GB 2431664 A 5/2007

*Primary Examiner* — Michael R Wills, III
(74) *Attorney, Agent, or Firm* — Mossman, Kumar & Tyler PC

(57) ABSTRACT

A downhole tool in a wellbore may be at least partially enclosed by a protector. The protector may form a physical barrier between the downhole tool and a wellbore environment. The protector include a sheath formed of a pliant material or a textile and may include one or more hard inserts.

13 Claims, 3 Drawing Sheets

(56) References Cited

U.S. PATENT DOCUMENTS

2014/0311756 A1* 10/2014 Dicke ..... E21B 17/1028
166/381
2015/0211324 A1* 7/2015 King ..... E21B 33/1208
166/285

* cited by examiner

PROTECTION OF DOWNHOLE TOOLS AGAINST MECHANICAL INFLUENCES WITH A PLIANT MATERIAL

CROSS-REFERENCE TO RELATED APPLICATIONS

None.

BACKGROUND OF THE DISCLOSURE

1. Field of the Disclosure

This disclosure relates generally to arrangements and related methods for protecting oilfield downhole tools from mechanical wear.

2. Background of the Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to tubing, which is usually either a jointed rigid pipe or flexible spoolable tubing commonly referred to in the art as "coiled tubing." The string comprising the tubing and the drilling assembly is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as the "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore. The mud motor is rotated by the drilling fluid passing through the drilling assembly. A drive shaft connected to the motor and the drill bit rotates the drill bit.

During wellbore operations, downhole tools with sensitive outer parts and/or equipment can be subjected to mechanical influences, such as abrasion, chipping and cuttings and chemical influences resulting from a direct contact with the mud flow. Prior to operation, downhole how tools may be subjected to electromagnetic radiation coming from tools storage and transportation on the ground. The present disclosure addresses the need to protect these sensitive parts and equipment.

SUMMARY OF THE DISCLOSURE

In aspects, the present disclosure provides an apparatus for use in a wellbore. The apparatus may include a downhole tool configured to physically transform to execute a specified downhole operation and a protector at least partially enclosing the downhole tool. The protector may form a physical barrier between the downhole tool and a wellbore environment. The protector may include a sheath formed of a pliant material.

In aspects, the present disclosure also provides an apparatus that includes a downhole tool configured to be conveyed into a wellbore to perform a specified downhole function and a protector at least partially enclosing the downhole tool. The protector may form a physical barrier between the downhole tool and a wellbore environment. The protector may include a sheath formed at least partially of a textile.

In aspects, the present disclosure further provides a method for using a downhole tool in a wellbore. The method may include at least partially enclosing the downhole tool using a protector; conveying the downhole tool and the protector into the wellbore, and executing a specified downhole operation. The protector may form a physical barrier between the downhole tool and a wellbore environment and include a sheath formed of a pliant material or a textile. The specified downhole operation may be executed by physically transforming the downhole tool.

Examples of certain features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

As will be appreciated from the discussion below, aspects of the present disclosure provide protection arrangements that use a pliant material to protect downhole tools from mechanical wear. Mechanical wear includes, but is not limited to, abrasion, chipping, fracturing, cracking, cutting, etc. In some embodiments, the pliant material may be a textile, e.g., a braided, knitted or woven fabric with optional wear-resistant inserts. While the discussion below is set in the context of a drilling system, it should be understood that the teachings of the present disclosure may be used in all phases of well construction and production (e.g., drilling, completion, production, workover, etc.).

Figure 1:
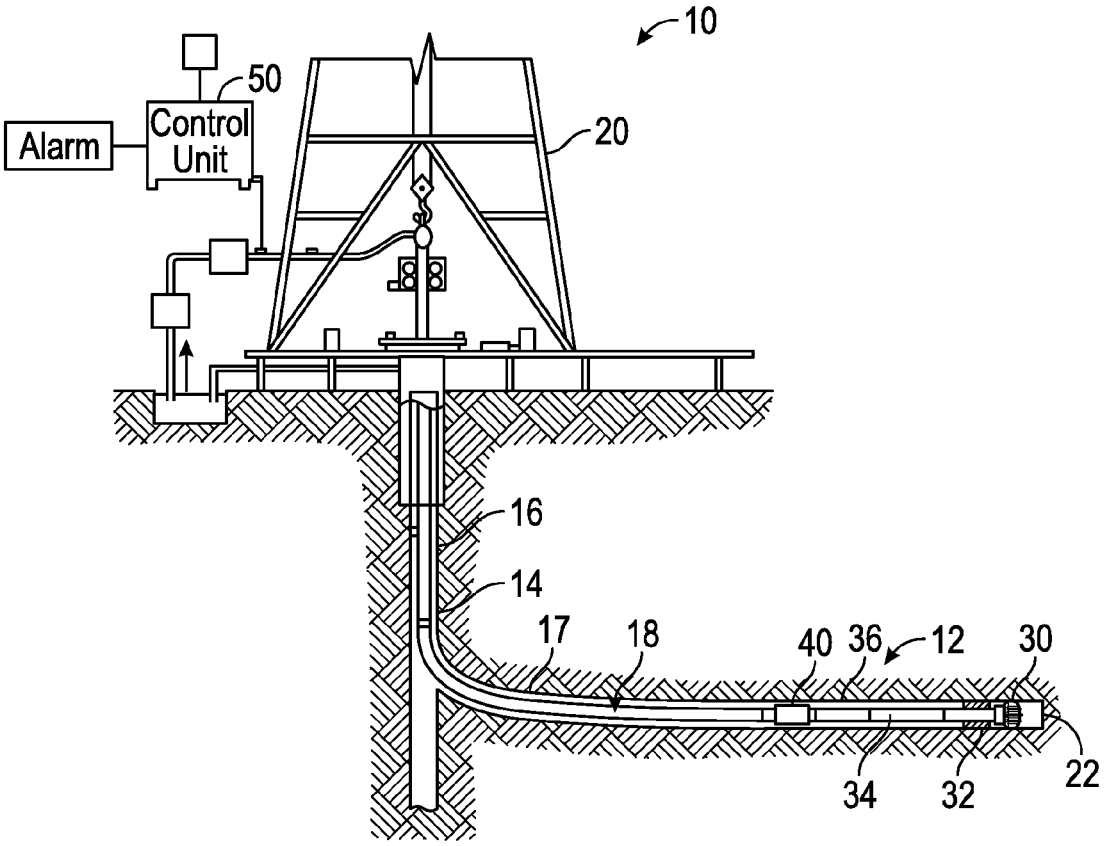
FIG. 1 illustrates a drilling system made in accordance with one embodiment of the present disclosure.

Referring now to FIG. 1, there is shown one illustrative embodiment drilling system 10 that includes a bottomhole assembly (BHA) 12 for drilling a wellbore 14. The wellbore 14 has a vertical section 16 and a deviated section 17. While shown as horizontal, the deviated section 17 may have any inclination or inclinations relative to vertical. Also, while a land-based rig is shown, these concepts and the methods are equally applicable to offshore drilling systems. The system 10 may include a drill string 18 suspended from a rig 20. The drill string 18, which may be jointed tubulars or coiled tubing, may include power and/or data conductors such as wires for providing bidirectional communication and power transmission. In one configuration, the BHA 12 includes a drill bit 30, a steering assembly 32 that steers the drill bit 30, a drilling motor 34 for rotating the drill bit 30, and a measurement-while-drilling (MWD) section 36.

Some of the tooling and equipment of the drill string 18 and the BHA 12 do not change shape or dimensions in order to operate as intended. Other tools undergo a physical transformation as part of their intended operation. A physical transformation can include a change in shape, size, or dimensions. Illustrative transformations include, but are not limited to, expansion, contraction, twisting, shifting, etc. By way of illustration, there is shown a packer device 40 positioned along the drill string 18. The packer device 40 may include an expandable annular sealing element. When activated, the packer device 40 may radially expand into a sealing engagement with an adjacent surface, such as a borehole wall.

Figure 2:
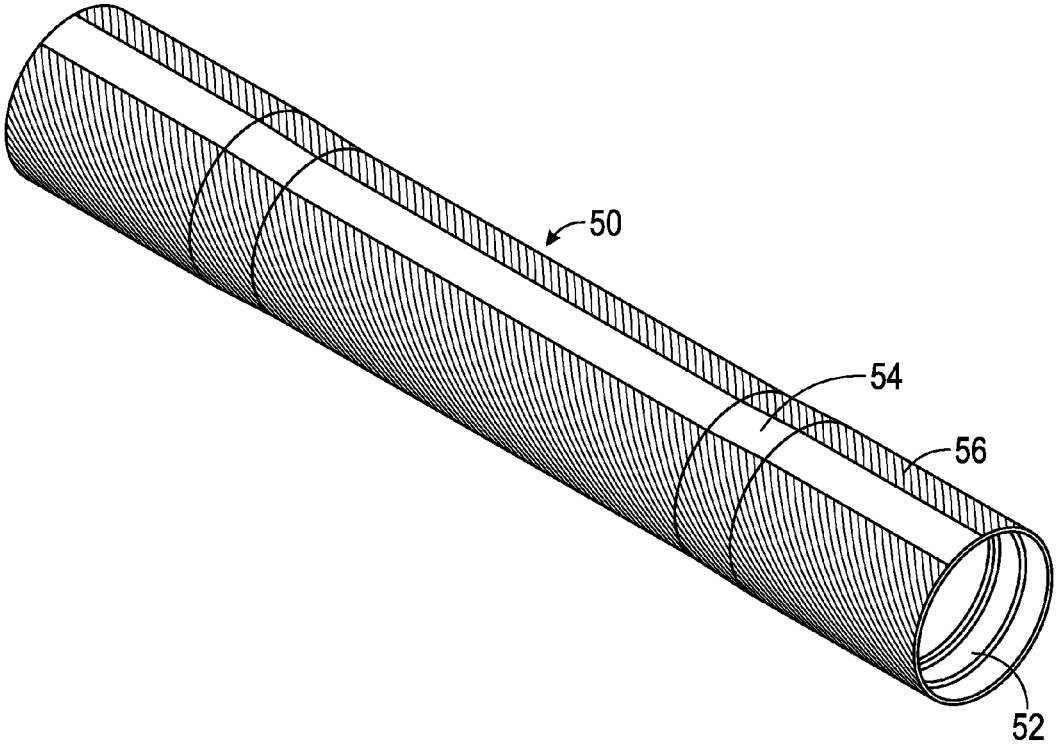
FIG. 2 schematically illustrates a protector for a downhole tool made in accordance with one embodiment of the present disclosure.

Referring now to FIG. 2, there is shown a downhole tool protector 50 that may be used to protect one or more downhole tools 52 of the drilling system 10 from mechanical wear. The downhole tool 52 may be physically static or undergo a physical deformation. The protector 50 encloses the downhole tool 52 and forms a physical barrier between the downhole tool 52 and the wellbore environment. The protector 50 may partially surround the downhole tool 52 by covering only the sensitive sections or completely surround the downhole tool 52. In the FIG. 2 embodiment, the protector 50 is external to and contacts an outer surface 54 of the downhole tool 52. Thus, debris or fluids in an annulus surrounding the downhole tool 52 contact the protector 50 instead of the outer surface 54 of the downhole tool 52.

In one embodiment, the protector 50 includes a sheath 56 that is formed of a pliant material. As used herein, a pliant material is a material that can physically transform or physically degrade. By physically transform, it is meant that the pliant material accommodates the physical transformation of the downhole tool 52 by also physically transforming (e.g., expanding, stretching, bending, etc.). Thus, in this arrangement, the sheath 56 is not damaged by the transformation. By physically degrade, it is meant the pliant material breaks up or otherwise structurally destabilizes while the downhole tools 52 physically transforms. In either case, the pliant material does not impede or prevent the physical transformation of the downhole tool 52.

A number of methodologies may be used to form the pliant material. For instance, a material having a modulus of elasticity that allows a preset amount of deformation and subsequent structural failure may be used. Alternatively or additionally, the sheath 56 may be formed with grooves, holes, or other features that initiate failure after a predetermined amount of deformation. In still other instances, the pliant material may be textile. As used herein, a textile may be structured as netting, knitting, braiding, weaving, meshing, lacing, or any other interconnection of fibers or strands. The material of the textile may be a mineral or synthetic. Illustrative mineral materials include, but are not limited to, glass fibers, metal fibers and metal wires. Synthetic textiles include, but are not limited to, polyester, aramid, acrylic, nylon, polyurethanes, olefins, and polylactides. Additionally, the material of the protector may include a coating of a secondary material to increase functionality.

In some embodiments, the sheath 56 may be constructed as a sacrificial layer that uses a material selected to resist wear long enough while being deployed downhole so that the underlying downhole tool is not physically compromised.

The sheath 56 may be formed as a sleeve that surrounds the downhole tool 52. In other embodiments, the sheath 56 may be wrapping that is layered around the downhole tool 52. In both instances, the sheath 56 is structurally separate from the underlying downhole tool 52.

Figure 3:
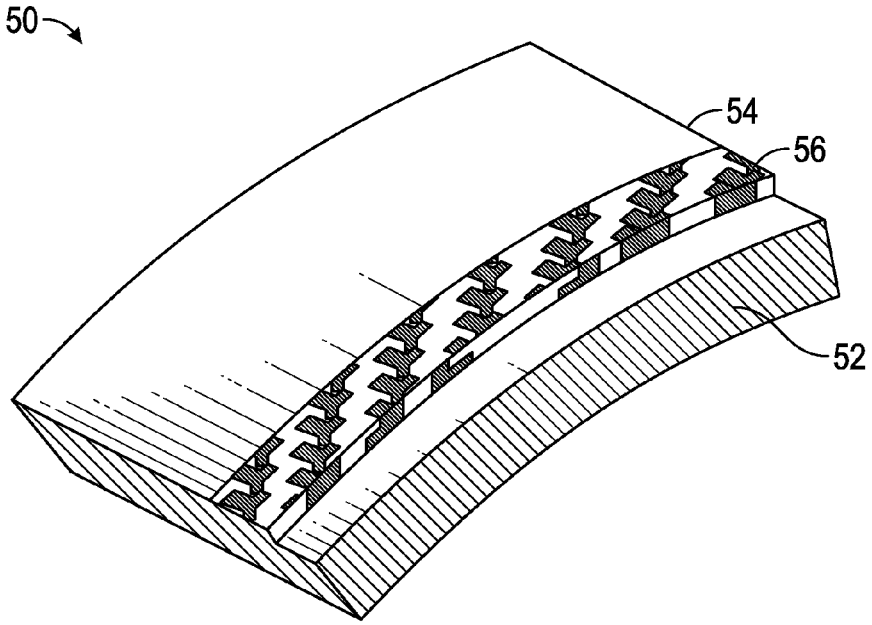
FIG. 3 schematically illustrates a protector integrated into a downhole tool in accordance with one embodiment of the present disclosure.

Referring to FIG. 3, there is shown another embodiment of a protector 50. In the FIG. 3 embodiment, the protector 50 is integrated into the outer surface 54 of the downhole tool 52. For example, the outer surface 54 may be formed of an elastomer such as rubber. Thus, the sheath 56 of the protector 50 may be embedded into the outer surface 54. By structurally integrated, it is meant that the material of the protector 50 and the material of the downhole tool 52 are not separated along a contiguous contact area. Instead, the materials are mixed or otherwise intricately bound with one another.

Figure 4A:
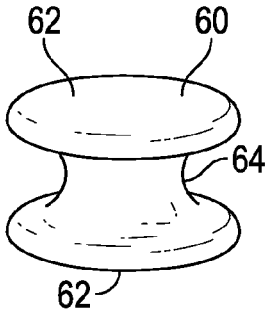
FIGS. 4A and 4B illustrate inserts hat may be used with protectors in accordance with the present disclosure.
Figure 4B:
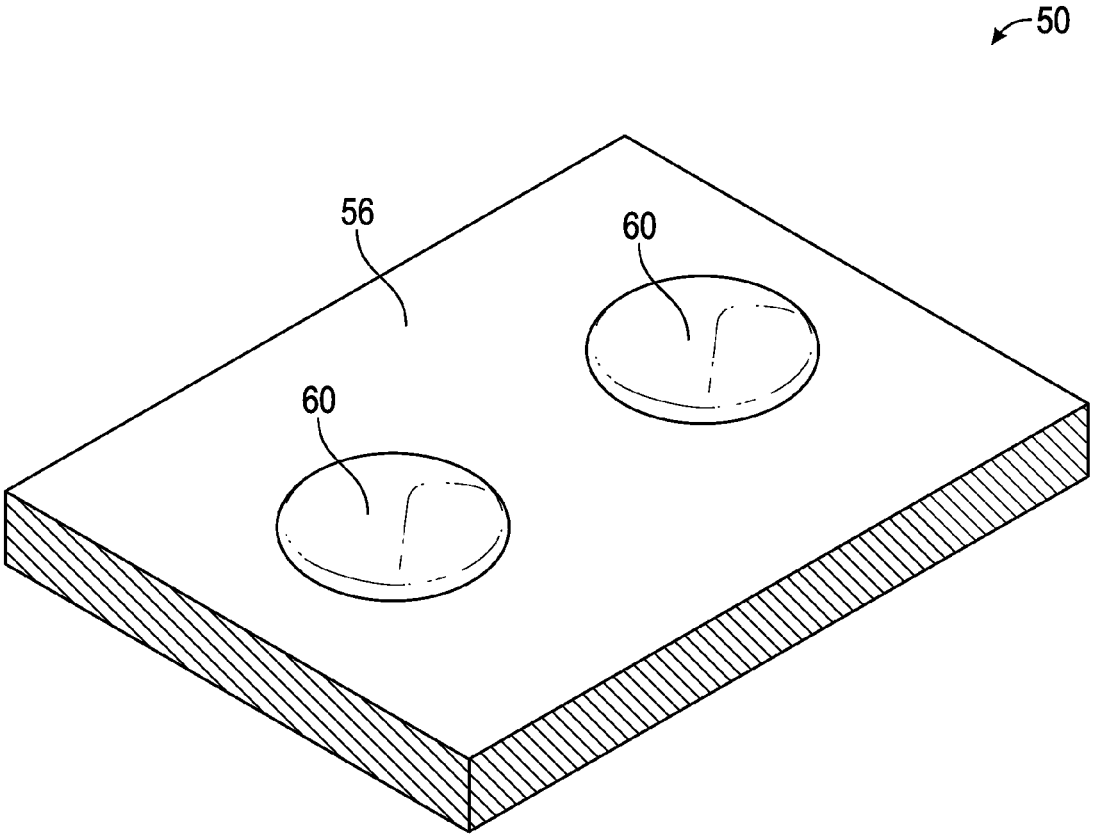

Referring now to FIGS. 4A and 4B, there are shown inserts 60 that may be integrated into the protector 50. The insert 60 may be formed of a material harder than the material of the sheath 56. In one non-limiting embodiment, the insert 60 may be formed of a metal carbide or other material that has very high wear resistance. Illustrative materials include, but are not limited to, silicon carbides, metals, metal alloys (e.g., steel), etc. In some arrangements, any material having a property that provides a wear resistance higher than that of the material of the sheath 56 may be used. Illustrative material properties include, but are not limited to, hardness, toughness, ductility, tensile strength, resilience, etc. In other arrangements, the insert 60 may be formed of the same material as the sheath 56, but shaped or dimension to act as a shield or "stand-off" that contacts an object before such an object contacts the sheath 56. The insert 60 may have opposing wear faces 62 that are connected by a neck 64. During the production of the fabric of the protector 50, the inserts 60 may be integrated into the fabric as shown in FIG. 4. The relatively smaller neck 64 allows the inserts 60 to be physically captured within the sheath 56. The inserts 60 may be shaped to ensure a tight seat within the fabric's structure at any point even while the fabric's deformation and only allows removal upon destruction of the fabric. In case of loss, the inserts 60 can easily be carried out of the bore by the mud flow.

The inserts 60 may provide protection in two ways. First, the inserts 60 may provide better wear resistance than the base material. Second, the inserts 60 may act as a guard or shield for the base material. That is, the inserts 60 may protect against the mechanical influence resulting from a contact with the borehole wall while the sheath 56 protects against cuttings. Thus, if there are hook-like structure on the borehole wall, the pliant material making up the sheath 56 is protected from continuously tearing single fibers, which would weaken the entire protector 50 until failure.

The operating mode of the protector 50 depends, in part, on the behavior of the tool to be protected. Some non-limiting operating modes are discussed below with references to FIGS. 1-4A-B.

In applications where the downhole tool 52 does not physically deform, the sheath 56 of the protector 50 may be formed using a textile, either with or without the inserts 60. At the surface, the sheath 56 may protect the downhole tool 52 during handling and transport, and possibly shield the downhole tool 52 from electromagnetic energy. Downhole, the sheath 56 may provide protection from mechanical wear. The sheath 56 may be structurally separate from or embedded in the downhole tool 52.

In applications where the downhole tool 52 does physically deform, the sheath 56 of the protector 50 may be formed using a pliant material, which may optionally be a textile and may optionally include the inserts 60. As before, the surface, the sheath 56 may protect the downhole tool 52 during handling and transport, and possibly from exposure to electromagnetic energy. Downhole, the sheath 56 may provide protection from mechanical wear. The sheath 56 may be structurally separate from or embedded in the downhole tool 52.

As noted above, the downhole tool 52, when activated, may physically transform (e.g., expand) in order to perform a specified downhole operation. By downhole operation, it is meant an act or process affecting the wellbore 14, the formation surrounding the wellbore 14, a fluid native to the formation, a fluid in the wellbore, and/or another downhole tool. For instance, a packer may be expanded to hydraulically isolate a portion of a wellbore. The protector 50 can have at least two distinct responses. The protector 50 may expand and fully accommodate the transformation of the downhole tool 52. In this response, the protector 50 retains structural integrity and continues to provide protection after the underlying tool changes shape or deforms. In another response, the protector 50 may partially or completely physically degrades to allow the underlying downhole tool 52 to transform (e.g., expand, twist, axially shift, etc.). For example, the protector 50 may fray, break, snap, etc.

As used above, the term "mechanical wear" or "mechanical influence" refers to a degradation of an object due principally to physical contact with another object. This is in contrast to chemical influence in which a chemical reaction principally causes the degradation or radiation influence wherein an energy wave or beam principally causes the degradation.

While the foregoing disclosure is directed to the one mode embodiments of the disclosure, various modifications will be apparent to those skilled in the art. It is intended that all variations within the scope of the appended claims be embraced by the foregoing disclosure.

The invention claimed is:

1. An apparatus for use in a wellbore, comprising:

a drill string configured to drill the wellbore;

a downhole tool conveyed by the drill string and configured to physically transform to execute a specified downhole operation; and a protector at least partially enclosing the downhole tool and forming a physical barrier between the downhole tool and a wellbore environment, the protector including a sheath formed of a woven pliant material.

2. The apparatus of claim 1, wherein the protector continues to at least partially enclose the downhole tool after the downhole tool has completed a physical transformation.

3. The apparatus of claim 1, wherein the protector structurally degrades while the downhole tool physically transforms.

4. The apparatus of claim 1, wherein: the downhole tool is an expandable packer, the pliant material includes a textile, and the sheath is structurally separate from the downhole tool.

5. The apparatus of claim 1, wherein the sheath includes at least one insert formed of a material harder than the pliant material, the at least one insert having a wear surface standing off a surface of the sheath, the wear surface being positioned to contact an object before the object contacts the sheath.

6. The apparatus of claim 1, wherein the sheath is configured to shield at least a portion of the downhole tool from electromagnetic energy.

7. A method for using a downhole tool in a wellbore, comprising:

at least partially enclosing the downhole tool using a protector, the protector forming a physical barrier between the downhole tool and a wellbore environment, the protector including a sheath formed of at least one of: a woven pliant material, and a woven textile;

conveying the downhole tool and the protector into the wellbore using a drill string conveyed to drill the wellbore; and executing a specified downhole operation.

8. The method of claim 7, wherein the protector continues to at least partially enclose the downhole tool after the downhole tool has completed a physical transformation.

9. The method of claim 7, wherein the protector structurally degrades while the downhole tool physically transforms.

10. The method of claim 7, wherein the specified downhole operation is executed by physically transforming the downhole tool.

11. An apparatus for use in a wellbore, comprising:

a downhole tool configured to be conveyed into a wellbore to perform a specified downhole function, the downhole tool being configured to physically transform to execute a specified downhole operation; and a protector at least partially enclosing the downhole tool and forming a physical barrier between the downhole tool and a wellbore environment, the protector including a sheath formed at least partially of a textile, wherein the textile is structured as at least one of: netting, knitting, braiding, weaving, meshing, and lacing, wherein the sheath is structurally separate from the downhole tool, wherein the protector retains structural integrity as the physical barrier after the physical transformation of the downhole tool.

12. The apparatus of claim 11, wherein the sheath includes at least one insert formed of a material harder than the textile, the at least one insert having a wear surface standing off a surface of the sheath, the wear surface being positioned to contact an object before the object contacts the sheath.

13. The apparatus of claim 11, wherein the sheath is formed at least partially of one of: (i) glass fibers, (ii) metal fibers, (iii) metal wires, and (iv) a polymeric fiber.

* * * * *